US007114187B1

(12) United States Patent
Parker

(10) Patent No.: US 7,114,187 B1
(45) Date of Patent: Oct. 3, 2006

(54) SPORTS FAN HANDKERCHIEF

(76) Inventor: Callie J. Parker, 3017 49th St. South #6, Gulfport, FL (US) 33707

( * ) Notice: Subject to any disclaimer, the term of this patent is extended or adjusted under 35 U.S.C. 154(b) by 0 days.

(21) Appl. No.: 11/192,746

(22) Filed: Jul. 29, 2005

Related U.S. Application Data

(60) Provisional application No. 60/605,152, filed on Aug. 27, 2004.

(51) Int. Cl.
*A41D 13/08* (2006.01)

(52) U.S. Cl. ..... 2/16

(58) Field of Classification Search ..... 2/16, 2/21, 163, 207, 1, 279; D2/500, 502
See application file for complete search history.

(56) References Cited

U.S. PATENT DOCUMENTS 2,695,999 A * 12/1954 Arnold ..... 2/20
2,925,605 A * 2/1960 Wheeler ..... 2/21
5,467,478 A * 11/1995 Slaughter et al. ..... 2/1

* cited by examiner

*Primary Examiner*—Tejash Patel
(74) *Attorney, Agent, or Firm*—Kenneth L Tolar

(57) ABSTRACT

The present invention relates to a sports fan handkerchief including a sheet having a sports emblem integrally embossed thereon. Attached to a corner of the sheet is a loop having an attachment ring positioned therein. The handkerchief can be conveniently secured to a sports fan by sliding the ring onto the fan's finger. Accordingly, the fan can wave the handkerchief without fear of inadvertently dropping or throwing it.

3 Claims, 1 Drawing Sheet

SPORTS FAN HANDKERCHIEF

CROSS REFERENCE TO RELATED APPLICATIONS

This application is entitled to the benefit of provisional application No. 60/605,152 filed on Aug. 27, 2004.

BACKGROUND OF THE INVENTION

The present invention relates to a novelty handkerchief having a uniquely designed finger ring for conveniently securing the handkerchief to a user's hand.

DESCRIPTION OF THE PRIOR ART

A variety of sports fan memorabilia for demonstratively displaying loyalty to a particular sports team exists in the prior art. For example, foam hands and thunder sticks are commonly used by fans at sporting events; however, they are extremely bulky and therefore difficult to transport. Though sports fan handkerchiefs exist in the prior art, they are extremely thin and cannot be secured to a person's hand. Therefore, to wave or display the handkerchief, the fan must grip it with the thumb and forefinger whereby it can be easily dropped or thrown. Accordingly, there is currently a need for a sports memorabilia item that is easier to use than conventional items. The present invention addresses this need by providing a uniquely designed sports handkerchief having an integral attachment ring for securing to a user's finger.

SUMMARY OF THE INVENTION

The present invention relates to a sports fan handkerchief. The device comprises a sheet formed of a durable, washable fabric such as nylon. Integrally embossed on the fabric is a sports emblem such as a team logo, colors, players' numbers or similar supportive design elements. Attached to an edge of the sheet, preferably at a corner thereof, is a loop formed of the same fabric material as the sheet. Received within the loop is an attachment ring for reception of a user's finger. The handkerchief can be conveniently secured to a sports fan by sliding the ring onto the fan's finger. Accordingly, the handkerchief can be waved without risk of being dropped or thrown.

It is therefore an object of the present invention to provide a sports fan handkerchief that can be conveniently secured to a user.

It is another object of the present invention to provide a sports fan handkerchief that eliminates the problems and inconveniences associated with conventional sports fan handkerchiefs.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 2:
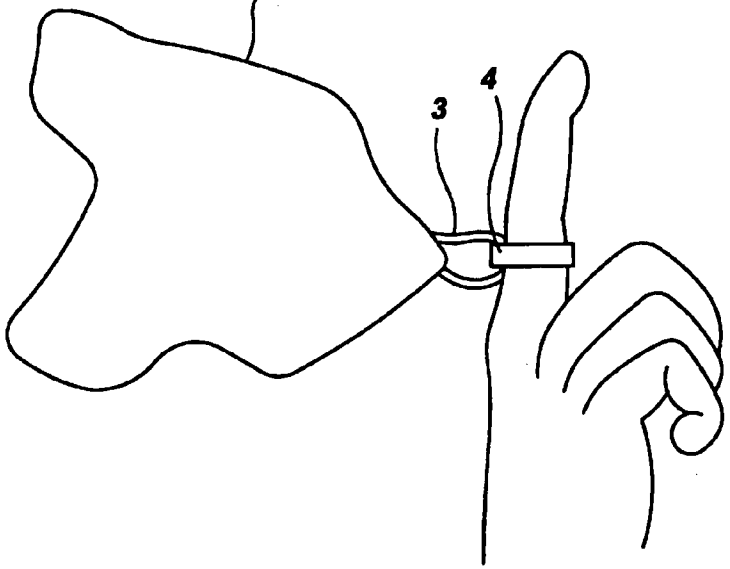
FIG. 2 is a perspective view of the handkerchief secured to a user's finger.
Figure 1:
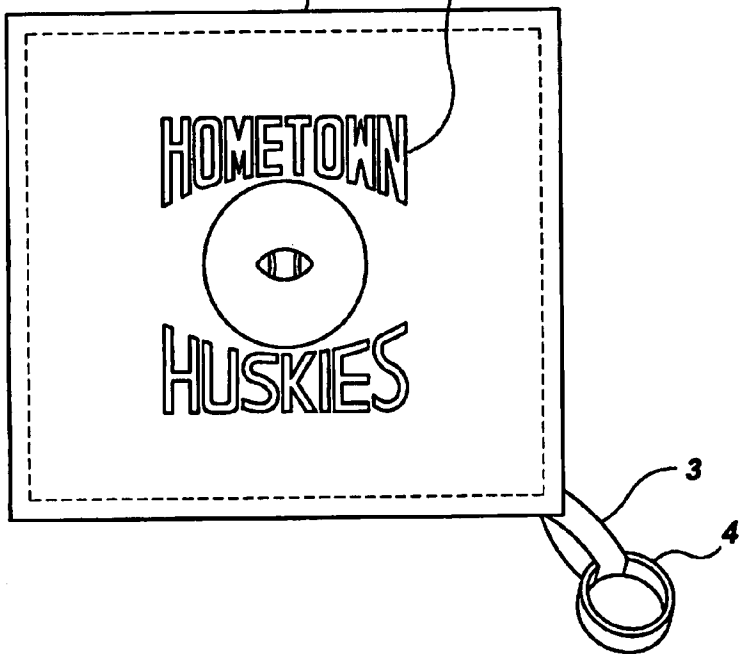
FIG. 1 is a plan view of the handkerchief according to the present invention.

The present invention relates to a sports fan handkerchief. The device comprises a sheet 1 formed of a durable, washable fabric such as nylon. Integrally embossed on the fabric is a sports emblem 2 such as a team logo, colors, players' numbers or similar supportive design elements.

Attached to an edge of the sheet, adjacent a corner thereof, is a loop 3 preferably formed of the same fabric material as the sheet. Secured within the loop is an attachment ring 4 for reception of a user's finger. The handkerchief can be conveniently secured to a sports fan by sliding the ring onto the fan's finger. Accordingly, the handkerchief can be waved without risk of being dropped or thrown.

The above described device is not limited to the exact details of construction and enumeration of parts provided herein. Furthermore, the size, shape and materials of construction can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A sports fan handkerchief comprising:

a sheet formed of a durable, washable fabric, said sheet having at least one outer peripheral edge;

a sports emblem embossed on said sheet;

a loop attached to the outer peripheral edge of said sheet;

an attachment ring received within said loop for reception of a user's finger whereby the handkerchief is conveniently securable to a sports fan by sliding the ring onto a finger.

2. The sports fan handkerchief according to claim 1 wherein said loop is formed of the same fabric material as said sheet.

3. A sports fan handkerchief comprising:

a sheet formed of a durable, washable fabric, said sheet having at least one outer peripheral edge with a corner thereon;

a sports emblem embossed on a side of said sheet;

a loop attached to the outer edge of said sheet, proximal the corner;

an attachment ring received within said loop for reception of a user's finger, said ring slidable on said loop whereby the handkerchief is conveniently securable to a sports fan by sliding the ring onto a finger.

* * * * *